US008973360B2

(12) United States Patent
Wu

(10) Patent No.: US 8,973,360 B2
(45) Date of Patent: Mar. 10, 2015

(54) PRESSURE CYLINDER HAVING A HIDDEN LOOP DESIGN

(75) Inventor: Tsai-Chao Wu, Taichung (TW)

(73) Assignee: Chanto Air Hydraulics Co., Ltd., Taichung (TW)

( * ) Notice: Subject to any disclaimer, the term of this patent is extended or adjusted under 35 U.S.C. 154(b) by 608 days.

(21) Appl. No.: 13/345,875

(22) Filed: Jan. 9, 2012

(65) Prior Publication Data

US 2013/0098240 A1 Apr. 25, 2013

(30) Foreign Application Priority Data

Oct. 21, 2011 (TW) ..... 100219900 U

(51) Int. Cl.
*F15B 3/00* (2006.01)

(52) U.S. Cl.
CPC ..... *F15B 3/00* (2013.01)
USPC ..... 60/581; 60/565

(58) Field of Classification Search
CPC .... F04B 3/00; F15B 11/0325; F15B 11/0725; F15B 2211/7053; F15B 2211/216
USPC ..... 92/5 R, 61, 62, 163, 169.1; 60/560, 565, 60/567, 574, 581
See application file for complete search history.

(56) References Cited

U.S. PATENT DOCUMENTS

| | | | | | |
|---|---|---|---|---|---|
| 1,024,395 | A * | 4/1912 | Canty | 60/542 |
| 3,791,780 | A * | 2/1974 | Fritch et al. | 418/60 |
| 3,875,365 | A * | 4/1975 | Beneteau | 219/89 |
| 4,149,384 | A * | 4/1979 | Marshall | 60/542 |
| 4,288,987 | A * | 9/1981 | Grullmeier | 60/560 |
| 4,440,022 | A * | 4/1984 | Masom | 73/293 |
| 5,125,234 | A * | 6/1992 | Yonezawa et al. | 60/563 |
| 5,483,796 | A * | 1/1996 | Ando | 60/560 |
| 5,526,644 | A * | 6/1996 | Brieschke | 60/565 |
| 5,649,424 | A * | 7/1997 | Valavaara | 60/560 |
| 5,943,862 | A * | 8/1999 | Malina | 60/560 |
| 6,735,944 | B2 * | 5/2004 | Sawdon | 60/560 |
| 8,147,215 | B2 * | 4/2012 | Rigal et al. | 417/258 |
| 2003/0172652 | A1 * | 9/2003 | Tohru | 60/560 |
| 2004/0028543 | A1 * | 2/2004 | Rapp | 417/417 |

* cited by examiner

*Primary Examiner* — Thomas E Lazo
(74) *Attorney, Agent, or Firm* — Browdy and Neimark, PLLC

(57) ABSTRACT

A pressure cylinder includes a pressure-boosting member set, an actuation member set, and a cylinder body, which defines two transversely extending air inlets, two transversely extending air outlets and two air passages respectively axially connected between the two air inlets and the two air outlets for allowing an applied compressed gas to flow through the two air inlets and the two air passages and the two air outlets into an air chamber in the cylinder body to move the pressure-boosting member set and the actuation member set in an oil accumulation chamber in the cylinder body. The hidden loop design for guiding the applied compressed gas does not require any extra pipelines and connectors, avoiding pipeline deterioration or connector loosening problems.

7 Claims, 5 Drawing Sheets

PRESSURE CYLINDER HAVING A HIDDEN LOOP DESIGN

BACKGROUND OF THE INVENTION

1. Field of the Invention

The present invention relates to a pressure cylinder and more particularly, to a pressure cylinder, which has a hidden loop design.

2. Description of the Related Art

The so-called pressure cylinder is a combination of an air cylinder and a hydraulic cylinder, which mainly uses a piston rod of the air cylinder to compress a hydraulic fluid in giving a pressure to a piston rod of the hydraulic cylinder, thereby enhancing the output force of the piston rod of the hydraulic cylinder.

However, in all conventional pressure cylinder designs, the applied compressed gas is flowing through a loop formed of external pipelines. After a long use, the external pipelines may be oxidized and deteriorated. Therefore, the pipelines must be regularly replaced. Further, the connectors connecting the pipelines may be loosened easily, causing a gas leak. All these problems may lead to machine failure, or even industrial accidents.

SUMMARY OF THE INVENTION

The present invention has been accomplished under the circumstances in view. It is the main object of the present invention to provide a pressure cylinder, which has a hidden loop design for guiding a compressed gas without any pipelines and connectors, avoiding pipeline deterioration or connector loosening problems.

To achieve this and other objects of the present invention, a pressure cylinder comprises a cylinder body, a pressure-boosting member set, and an actuation member set. The cylinder body comprises a first air chamber, a second air chamber, an oil accumulation chamber disposed between the first air chamber and the second air chamber, a first air outlet transversely disposed in communication with the first air chamber, a second air outlet transversely disposed in communication with the second air chamber, a first air inlet and a second air inlet transversely disposed in a parallel manner between the first air outlet and the second air outlet, a first air passage disposed in communication with the first air inlet and the first air outlet, and a second air passage disposed in communication with the second air inlet and the second air outlet. The pressure-boosting member set comprises a first piston set in the first air chamber of the cylinder body and movable axially relative to the cylinder body by an applied compressed gas, and a pressure-boosting piston rod and movable axially relative to said cylinder body by said first piston. The pressure-boosting piston rod has one end thereof connected to the first piston and an opposite end thereof inserted into the oil accumulation chamber of the cylinder body. The actuation member set comprises a second piston and an actuation piston rod. The second piston is set in the oil accumulation chamber of the cylinder body, defining therein an axially extending pressure-boosting chamber in communication with the oil accumulation chamber for receiving the pressure-boosting piston rod of the pressure-boosting member set. The actuation piston rod is movable axially relative to the cylinder body by the second piston, having one end thereof connected to the second piston and suspending between the second air chamber and the oil accumulation chamber, and an opposite end thereof extending out of the cylinder body.

Thus, the applied compressed gas can flow through the first air outlet, the first air passage and an internal loop being formed of the first air outlet into the first air chamber to move the pressure-boosting piston rod into the pressure-boosting chamber in compressing the hydraulic fluid in the pressure-boosting chamber to move the actuation piston rod of the actuation member set. Similarly, the compressed gas can be forced to flow through the second air outlet, the second air passage and another internal loop being formed of the second air outlet into the second air chamber to return the pressure-boosting member set and the actuation member set.

Other advantages and features of the present invention will be fully understood by reference to the following specification in conjunction with the accompanying drawings, in which like reference signs denote like components of structure.

DETAILED DESCRIPTION OF THE INVENTION

Figure 1:
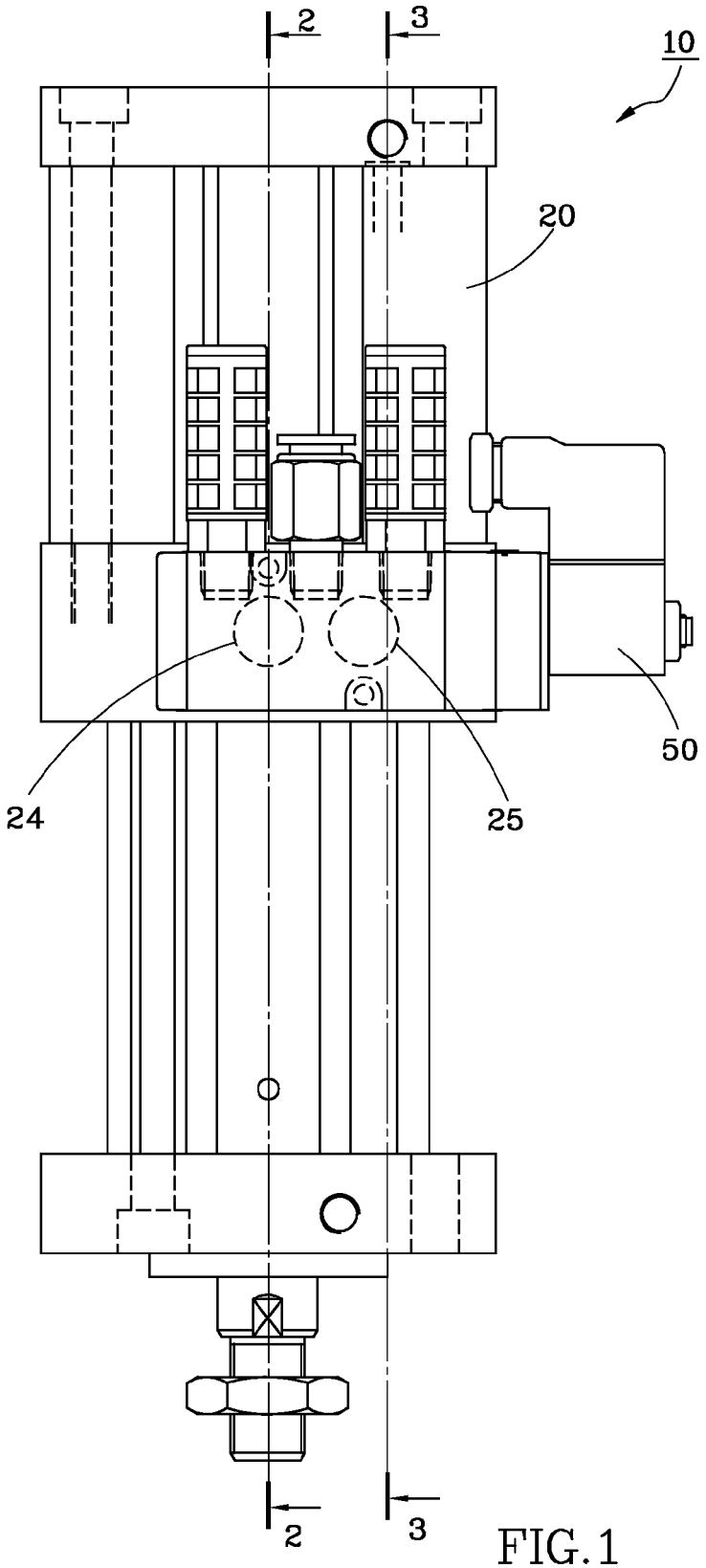
FIG. 1 is a plain view of a pressure cylinder in accordance with the present invention.
Figure 2:
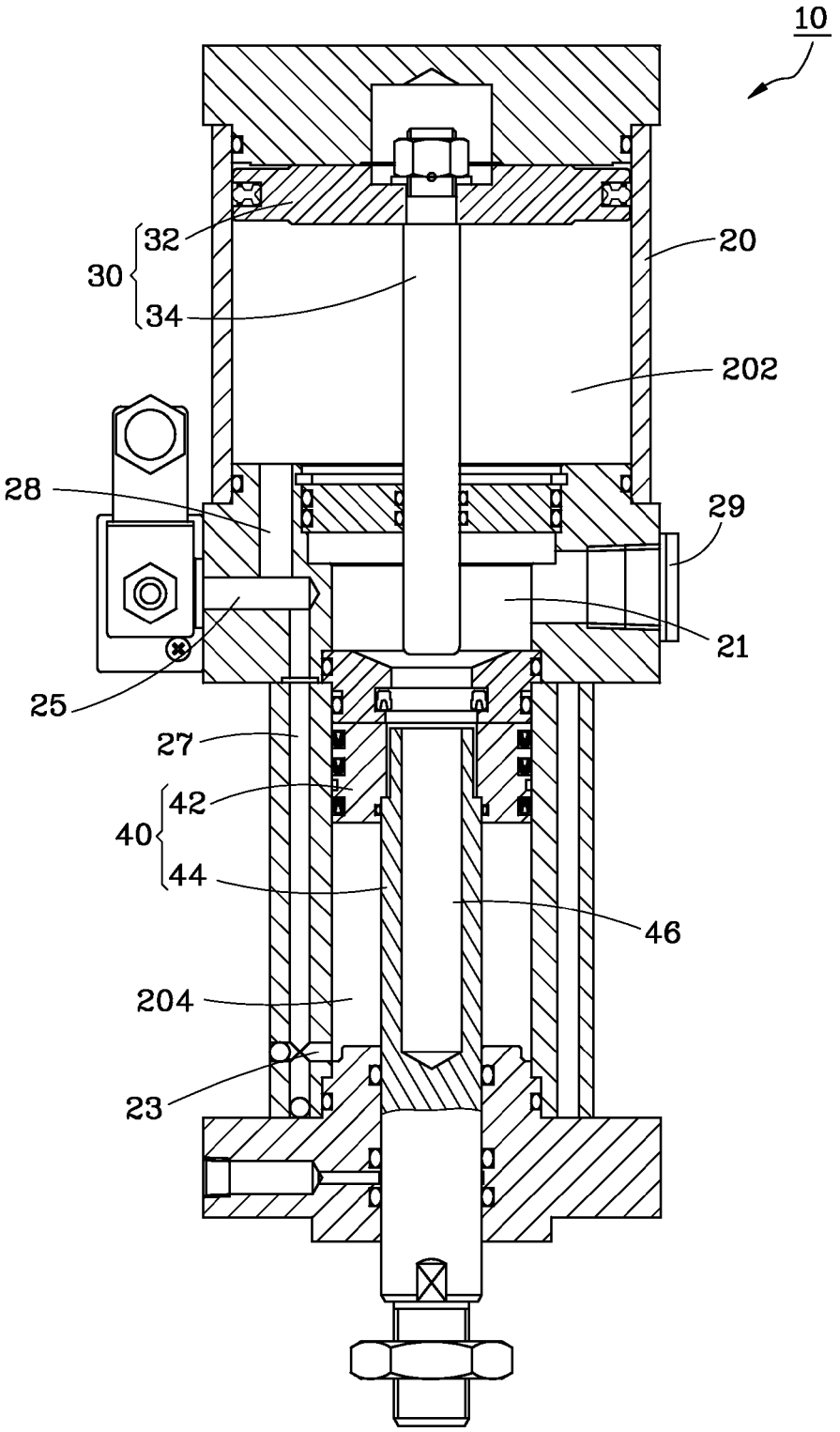
FIG. 2 is a sectional view taken along line 2-2 of FIG. 1.

Referring to FIGS. 1 and 2, a pressure cylinder 10 in accordance with the present invention is shown. The pressure cylinder 10 comprises a cylinder body 20, a pressure-boosting member set 30, and an actuation member set 40.

Figure 3:
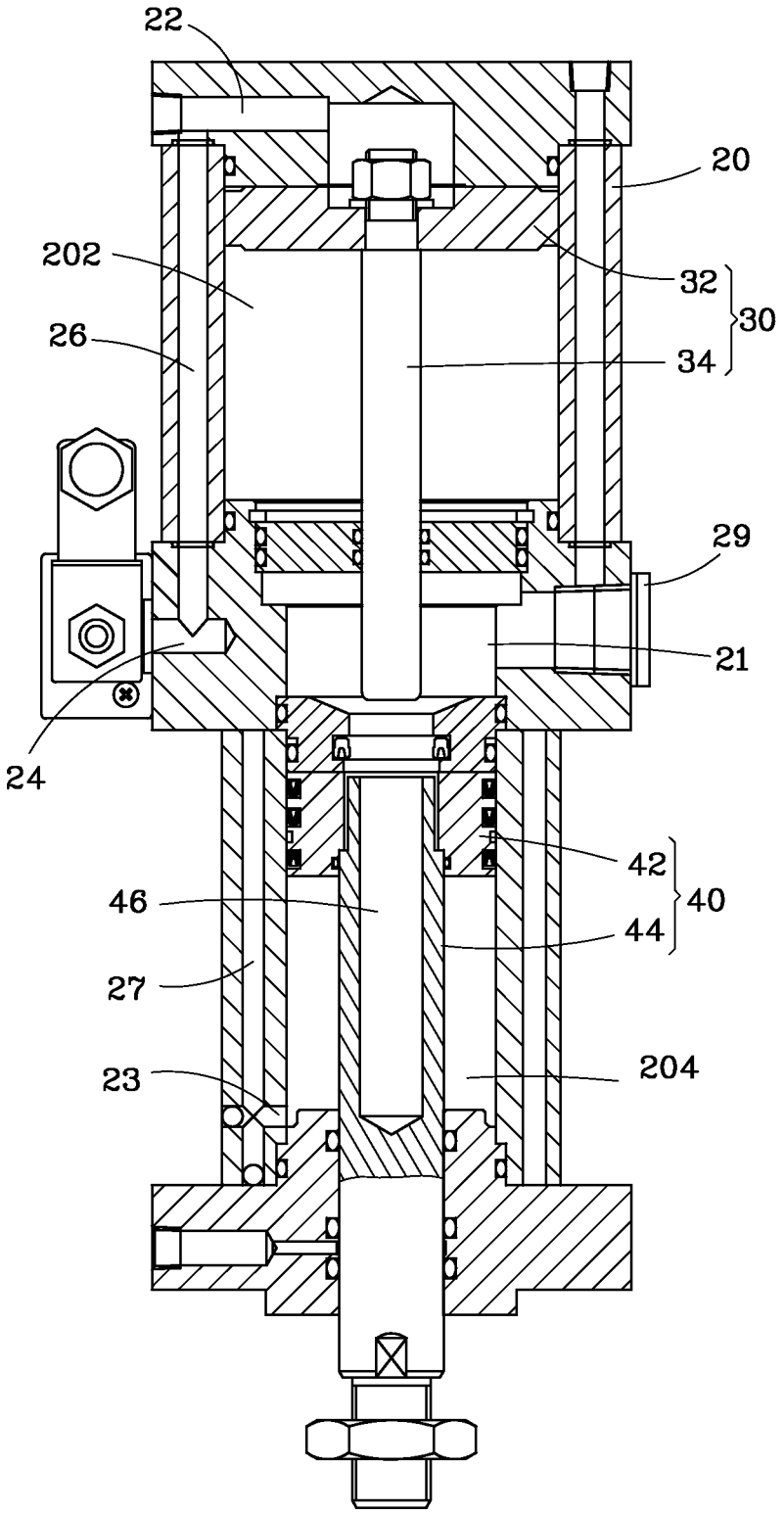
FIG. 3 is a sectional view taken along line 3-3 of FIG. 1.

Referring to FIG. 3, the cylinder body 20 comprises a first air chamber 202 defined in an upper part thereof, a second air chamber 204 defined in a lower part thereof, an oil accumulation chamber 21 disposed between the first air chamber 202 and the second air chamber 204, a first air outlet 22 transversely disposed at a top side thereof in communication with the first air chamber 202, a second air outlet 23 transversely disposed at a bottom side thereof in communication with the second air chamber 204, a first air inlet 24 and a second air inlet 25 transversely disposed in a parallel manner between the first air outlet 22 and the second air outlet 23, a first air passage 26 vertically disposed in communication with the first air inlet 24 and the first air outlet 22, a second air passage 27 vertically disposed in communication with the second air inlet 25 and the second air outlet 23 at one side relative to the second air inlet 25, and a third air passage 28 vertically disposed in communication with the second air inlet 25 and the first air chamber 202 at opposite side relative to the second air inlet 25. Further, an electromagnetic valve 50 is mounted at one side of the cylinder body 20 and connected to the first air inlet 24 and the second air inlet 25 for controlling the flowing direction of a compressed gas. Further, an oil immersion lens 29 is mounted at an opposite side of the cylinder body 20 corresponding to the oil accumulation chamber 21 for observing the condition of the accumulated hydraulic fluid in the oil accumulation chamber 21.

The pressure-boosting member set 30 comprises a first piston 32 and a pressure-boosting piston rod 34. The first piston 32 is set in the first air chamber 202 of the cylinder body 20, and movable along the axial direction of the cylinder body 20 by the pressure of a compressed gas. The pressure-boosting piston rod 34 has its one end connected to the first piston 32, and its other end inserted into the oil accumulation chamber 21 of the cylinder body 20 and movable along the axial direction of the cylinder body 20 by the first piston 32.

The actuation member set 40 comprises a second piston 42 and an actuation piston rod 44. The second piston 42 is set in the oil accumulation chamber 21 of the cylinder body 20, defining therein an axially extending pressure-boosting chamber 46 in communication with the oil accumulation chamber 21 for receiving the pressure-boosting piston rod 34 of the pressure-boosting member set 30. The actuation piston rod 44 has its one end connected to the second piston 42 and disposed in the second air chamber 204 and its other end extending out of the cylinder body 20, and is movable along the axial direction of the cylinder body 20 by the second piston 42.

Figure 4:
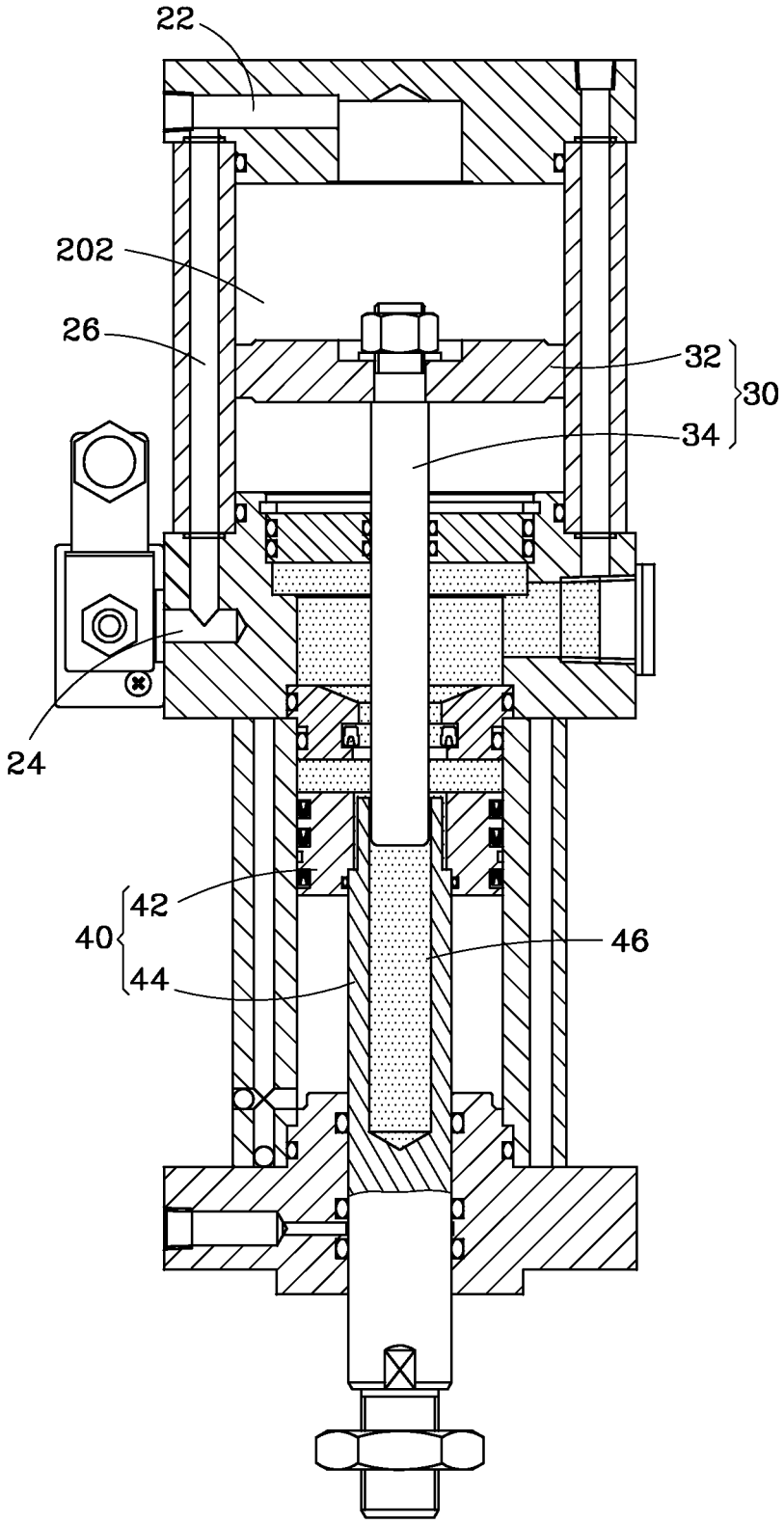
FIG. 4 is a schematic sectional view of the present invention, illustrating a pressure-boosting stroke of the pressure-boosting member set and the actuation member set.
Figure 5:
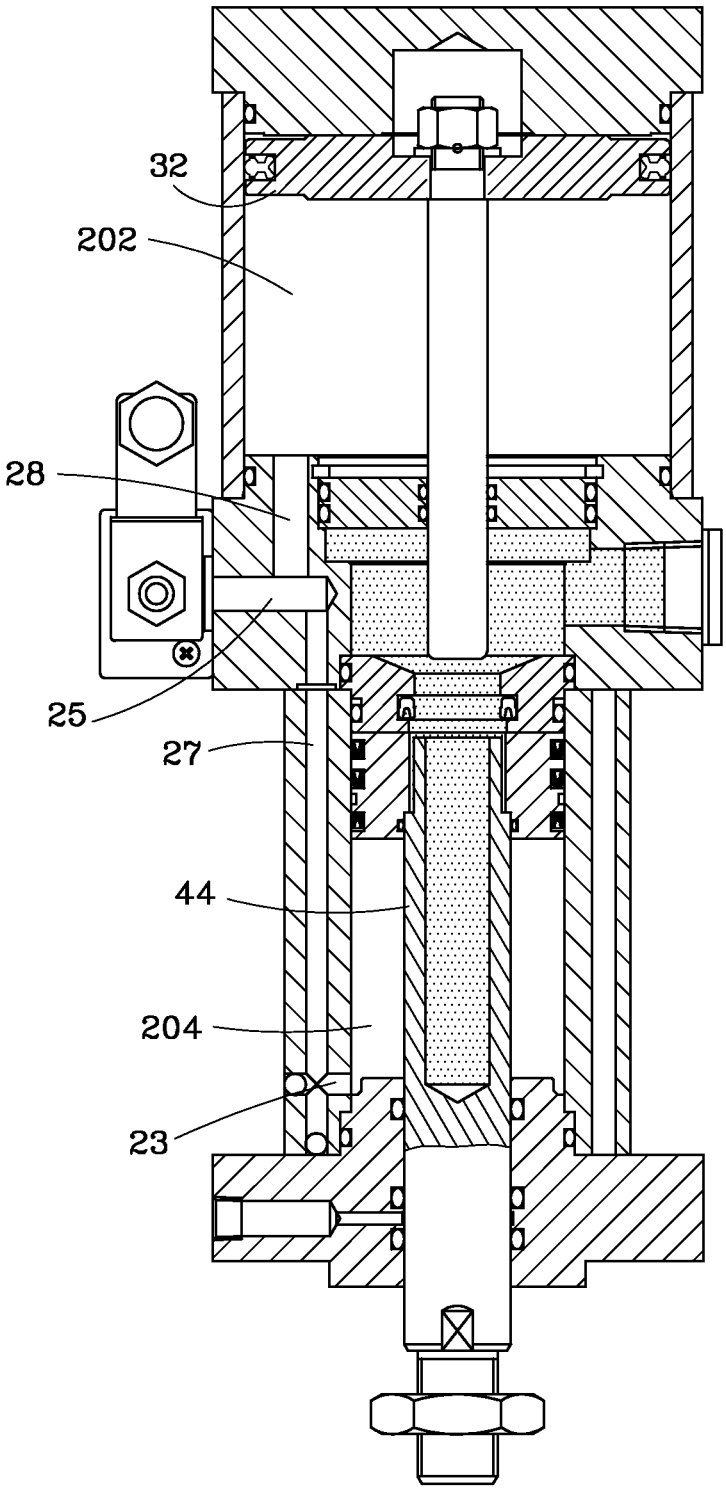
FIG. 5 is a schematic sectional view of the present invention, illustrating a return stroke of the pressure-boosting member set and the actuation member set.

When guiding an external compressed gas through the first air inlet 24 of the cylinder body 20 into the first air chamber 202 via the first air outlet 22, the first piston 32 of the pressure-boosting member set 30 will be forced downwards to move the pressure-boosting piston rod 34 into the pressure-boosting chamber 46 of the second piston 42 of the actuation member set 40, thereby compressing the hydraulic fluid in the pressure-boosting chamber 46 to move the actuation piston rod 44 of the actuation member set 40, as shown in FIG. 4. On the contrary, when the flowing direction of the applied compressed gas is changed subject to the control of the electromagnetic valve 50, i.e., the compressed gas is forced to flow through the second air inlet 25 of the cylinder body 20 toward the second air passage 27 and the second air outlet 23 into the second air chamber 204 and also toward the third air passage 28 into the first air chamber 202, the first piston 32 of the pressure-boosting member set 30 and the actuation piston rod 44 of the actuation member set 40 are simultaneously forced by the pressure of the compressed gas to move upwardly to their respective former positions, as shown in FIG. 5.

Based on the aforesaid arrangement, either during the pressure-boosting stroke or return stroke of the pressure-boosting member set and the actuation member set, the compressed gas is flowing in the hidden loop inside the cylinder body. Thus, the invention does not require any extra pipelines or connectors, avoiding pipeline deterioration or connector loosening problems.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pressure cylinder, comprising:

a cylinder body comprising a first air chamber, a second air chamber, an oil accumulation chamber disposed between said first air chamber and said second air chamber, a first air outlet transversely disposed in communication with said first air chamber, a second air outlet transversely disposed in communication with said second air chamber, a first air inlet and a second air inlet transversely disposed in a parallel manner between said first air outlet and said second air outlet, a first air passage disposed in communication with said first air inlet and said first air outlet and a second air passage disposed in communication with said second air inlet and said second air outlet;

a pressure-boosting member set comprising a first piston set in said first air chamber of said cylinder body and movable axially relative to said cylinder body by an applied compressed gas and a pressure-boosting piston rod having one end thereof connected to said first piston and an opposite end thereof inserted into said oil accumulation chamber of said cylinder body and movable axially relative to said cylinder body by said first piston; and an actuation member set comprising a second piston and an actuation piston rod, said second piston being set in said oil accumulation chamber of said cylinder body, said second piston defining therein an axially extending pressure-boosting chamber in communication with said oil accumulation chamber for receiving said pressure-boosting piston rod of said pressure-boosting member set, said actuation piston rod having one end thereof connected to said second piston and suspending between said second air chamber and said oil accumulation chamber and an opposite end thereof extending out of said cylinder body and being movable axially relative to said cylinder body by said second piston;

wherein the applied compressed gas flows through the first air outlet, the first air passage and an internal loop formed of the first air outlet into the first air chamber to enable the pressure-boosting member set to compress the hydraulic fluid in the pressure-boosting chamber so as to move the actuation member set;

wherein the compressed gas flows through the second air outlet, the second air passage and another internal loop formed of the second air outlet into the second air chamber to return the pressure-boosting member set and the actuation member set; and wherein the first air passage is axially disposed in the cylinder body and communicated with said first air inlet and said first air outlet, and the second air passage is axially disposed in the cylinder body and communicated with said second air inlet and said second air outlet.

2. The pressure cylinder as claimed in claim 1, further comprising an electromagnetic valve mounted at said cylinder body and coupled to said first air inlet and said second air inlet for controlling a flow direction of the compressed gas.

3. The pressure cylinder as claimed in claim 2, wherein said cylinder body further comprises a third air passage disposed in communication with said second air inlet and said first air chamber at one lateral side relative to said second air inlet and opposite to said second air passage.

4. The pressure cylinder as claimed in claim 2, wherein said cylinder body further comprises an oil immersion lens mounted at one side thereof corresponding to said oil accumulation chamber.

5. The pressure cylinder as claimed in claim 1, wherein said cylinder body further comprises a third air passage disposed in communication with said second air inlet and said first air chamber at one lateral side relative to said second air inlet and opposite to said second air passage.

6. The pressure cylinder as claimed in claim 5, wherein said cylinder body further comprises an oil immersion lens mounted at one side thereof corresponding to said oil accumulation chamber.

7. The pressure cylinder as claimed in claim 1, wherein said cylinder body further comprises an oil immersion lens mounted at one side thereof corresponding to said oil accumulation chamber.

* * * * *